US005749782A

United States Patent [19]

Boldrini

[11] Patent Number: 5,749,782

[45] Date of Patent: May 12, 1998

[54] EQUIPMENT FOR CONVEYING ARTICLES OF ROD-LIKE APPEARANCE, IN PARTICULAR CIGARETTES

[75] Inventor: Fulvio Boldrini, Ferrara, Italy

[73] Assignee: G. D. S.p.A., Bologna, Italy

[21] Appl. No.: 709,741

[22] Filed: Sep. 9, 1996

[30] Foreign Application Priority Data

Sep. 7, 1995 [IT] Italy ..... BO95A0417

[51] Int. Cl.[6] ..... A24C 5/00

[52] U.S. Cl. ..... 454/370; 131/280; 131/283

[58] Field of Search ..... 236/44.3; 454/224, 454/233, 236, 234, 370; 131/280, 282, 283, 303

[56] References Cited

U.S. PATENT DOCUMENTS 4,254,858 3/1981 Seragnoli ..... 198/347
4,724,429 2/1988 Millen et al. ..... 131/280 X
5,400,612 3/1995 Hedges ..... 62/171
5,462,071 10/1995 Heitmann ..... 131/280

FOREIGN PATENT DOCUMENTS 42 24 609 1/1994 Germany .
2 298 121 8/1996 United Kingdom .

*Primary Examiner*—Harold Joyce
*Attorney, Agent, or Firm*—IP Group of Pillsbury Madison & Sutro LLP

[57] ABSTRACT

In equipment utilized for conveying rod-like articles such as cigarettes, which typically are held for a given duration while in transit inside at least one enclosure, a favorable atmosphere is maintained within the enclosure by means of an air conditioning unit interlocked to an array of sensors, located in and monitoring significant parameters internally of the enclosure itself, and governed by a control unit operating in conjunction with the sensors.

5 Claims, 1 Drawing Sheet

EQUIPMENT FOR CONVEYING ARTICLES OF ROD-LIKE APPEARANCE, IN PARTICULAR CIGARETTES

BACKGROUND OF THE INVENTION

The present invention relates to an item of equipment for conveying articles of rod-like appearance, in particular cigarettes.

More exactly, the present invention is concerned with conveying systems able to provide a direct connection between two or more machines installed along cigarette manufacturing and/or packaging lines. These, by way of example, can be cigarette-making machines, and wrapping machines by which the finished cigarettes are assembled and enveloped in packets.

Conveyors of the type in question can be interposed between one or more manufacturing machines and one or more wrapping machines, or between individual stations operating on either of the aforementioned lines. More generally, such a conveyor will be located between an up-line station, from which articles emerge en masse, and a down-line station in receipt of the those articles.

While reference is made throughout the specification to cigarettes as being the rod-like articles conveyed, no limitation in the general scope of the invention is implied.

The typical conveyor comprises means by which to support and transfer the cigarettes, possibly embodied as magazines of variable capacity. Such means consist of bands or belts arranged so as to form a complex of channels, varying in geometry and orientation, along which the cigarettes advance continuously en masse. It is often the case that static-flow compensating magazines are associated with the conveyors or with other machines of the line. Such magazines house a plurality of containers which are filled in their turn with cigarettes.

Albeit nominally efficient in terms of performing the function for which they are intended, the conventional types of equipment briefly outlined above nonetheless betray one serious drawback in certain circumstances, concerning the integrity of the cigarettes contained within and handled by them.

It can happen in fact that the accumulated cigarettes remain inside the magazines for a comparatively long duration, especially when the magazines themselves are required to perform a flow compensating function. As a person skilled in the art will know, the quality of cigarettes is significantly influenced by ambient conditions, i.e. by parameters characterizing the air of the environment in which the cigarettes happen to exist, sometimes for long periods, namely temperature, humidity and draft or convection.

Attempts have been made in the past to address such problems, for example adopting a solution as disclosed in patent application DE OS 42 24 609, where the time spent by the mass of cigarettes inside the conveyor is reduced not least by ensuring that the first cigarette admitted will swiftly be the first to emerge. Referred to conventionally as "First In, First Out", systems of this type afford some measure of success in overcoming the technical difficulty posed by the need to maintain the cigarettes in good condition internally of the conveying environment, though the respective equipment is always complex in construction, costly, and none too practical.

The object of the invention is to provide equipment for conveying articles of rod-like appearance, and in particular cigarettes, from which all the drawbacks mentioned in connection with the prior art are absent.

SUMMARY OF THE INVENTION

The stated object is realized in accordance with the present invention by the adoption of equipment for conveying rod-like articles, in particular cigarettes, comprising at least one magazine located between at least one station or machine dispensing such articles and at least one station or machine in receipt of the selfsame articles, and providing channels serving to support and transfer the articles, of which certain at least constitute a part of the magazine and establish respective enclosures destined to accommodate the articles.

Advantageously, the air inside the enclosures is conditioned by means comprising an air conditioning unit, connected with the enclosures and interlocked to sensing means positioned in the those enclosures and designed to monitor operating parameters of the equipment and/or conditions relative to the air. In operation, the air conditioning unit is governed by an electronic monitoring and control unit connected to and piloted by the sensing means.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
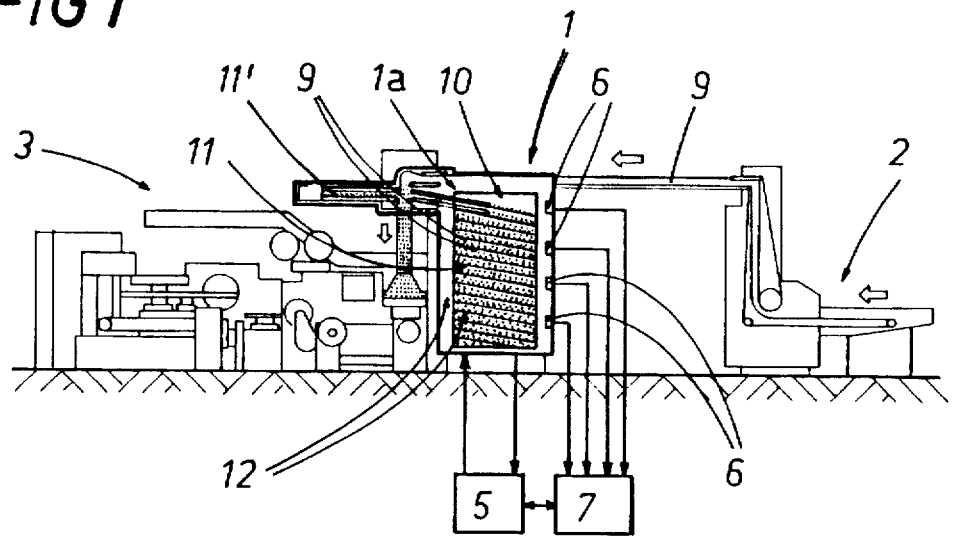
FIG. 1 shows a first example of equipment embodied in accordance with the present invention, illustrated schematically.

Referring to the aforementioned drawings, the present invention relates to equipment for conveying articles of rod-like appearance, and in particular cigarettes, which equipment is denoted 1 in its entirety.

The equipment 1 occupies a position between an up-line station denoted 2, typically a cigarette manufacturing machine from which cigarettes 9 emerge en masse in a continuous stream, and a down-line station denoted 3, for example a cigarette packaging or wrapping machine in receipt of the stream of cigarettes 9.

In particular, the equipment 1 comprises a magazine 1*a* located between the two machines 2 and 3, conventional in embodiment and of a type disclosed in U.S. Pat. No. 4,254,858, of which the interior provide a channel 11 serving to support and transfer the mass of cigarettes 9.

The magazine 1*a* performs a flow-compensating function in respect of the mass of cigarettes 9, which having left the up-line station or machine 2 must be taken up ultimately by the down-line station or machine 3. The cigarettes 9 are also transferred along a number of channels denoted 11' in the drawings, which do not form part of the magazine 1*a*.

Figure 3:
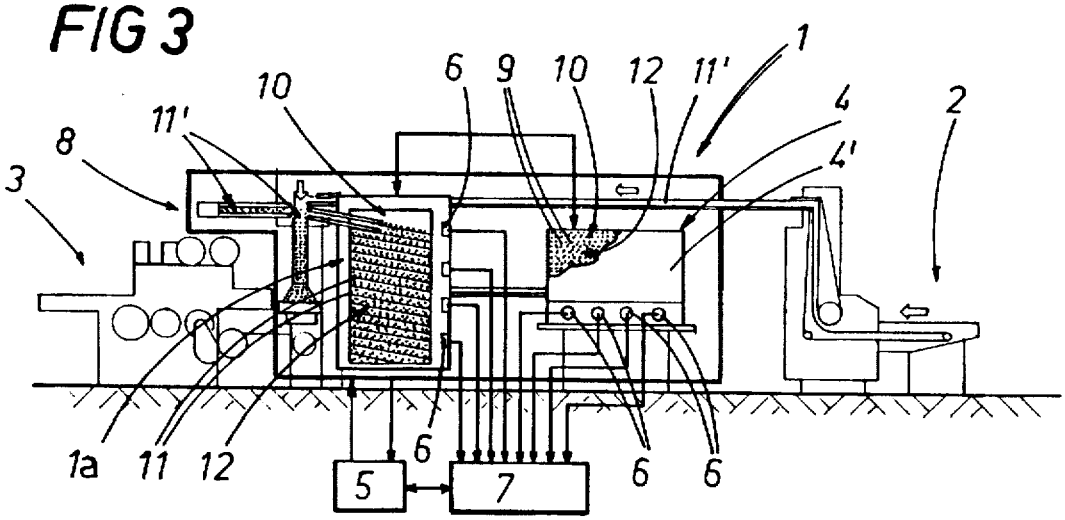
FIG. 3 illustrates a variation in embodiment of the equipment as in FIG. 2.

In the example of FIG. 3, the magazine 1*a* comprises a unit 4 for the storage and handling of containers 4' filled with cigarettes.

The channel 11 supporting and transferring the mass of cigarettes 9 creates an environment in which to house the cigarettes, as also does the space 10 encompassed by the containers 4'. More exactly, these environments constitute enclosures 12 in which the cigarettes are destined to be held for a period of given duration. In equipment 1 according to the present invention, the air inside the enclosures 12 is conditioned so as to create an atmosphere considered ideal for the purpose of maintaining the mass of cigarettes 9 in a state of faultless preservation.

To this end, the equipment 1 comprises a conditioning unit 5, which in the example of FIG. 1 is connected directly with the magazine 1*a*; in this instance, the magazine 1*a* is equipped with suitable sealing elements able substantially to prevent any exchange of unconditioned air between the environments excluded by and compassed within the enclosures 12.

The equipment also comprises a plurality of sensors 6 located internally of the enclosures 12 and capable notionally of monitoring not only parameters relative to the air, namely temperature, humidity and movement, but also operating parameters such as the quantity, hence the volume, of the mass of cigarettes 9 present at any given moment in the magazine 1*a* and the storage and handling unit 4, which affect the condition of the air. The air within the enclosures 12 can in fact be influenced both by external climatic conditions (the environment in which the equipment 1 operates) and by the type and quantity of the cigarettes 9 advancing through and held temporarily en masse internally of the magazine 1*a*.

The elements of information gathered by the sensors 6 are relayed to an electronic monitoring and control unit 7 of conventional embodiment such as furnishes suitable output signals at least to the conditioning unit 5.

Figure 2:
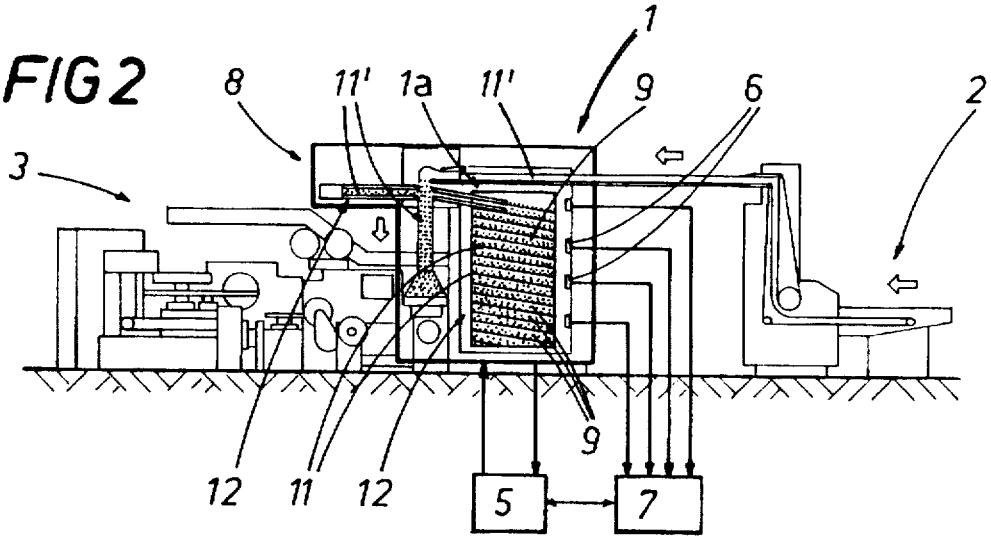
FIG. 2 shows a second example of equipment embodied in accordance with the present invention, illustrated schematically.

In a second embodiment of the invention, illustrated in FIGS. 2 and 3, the magazine la and the channels 11' located externally of the magazine are enclosed within a substantially airtight outer container or casing 8. In this instance, the air-conditioning unit 5 can be connected directly to the casing 8 and the magazine 1*a* requires no special modification, given that the enclosures 12 are compassed within an air-conditioned envelope afforded by the outer casing 8.

What is claimed:

1. Equipment for conveying rod-like articles, comprising:

at least one magazine located between at least one station or machine dispensing such rod-like articles and at least one station or machine receiving said articles, each said magazine having channels serving to support and transfer said articles, at least some of said channels constituting respective enclosures arranged to accommodate said articles;

means for conditioning air internally of said enclosures, said means for conditioning air including an air-conditioning unit that is connected with said enclosures, sensing means interlocked to said air-conditioning unit and located within said enclosures, said sensing means being arranged to monitor at least one of operating parameters of said equipment and conditions relative to the said air and an electronic monitoring and control unit connected to and operating in conjunction with the sensing means and being arranged to control operation of said air-conditioning unit.

2. The equipment of claim 1, wherein:

said enclosures are airtight and substantially prevent any exchange of unconditioned air with an excluded environment.

3. The equipment of claim 1, further comprising:

a substantially airtight casing encompassing each said magazine and accommodating at least part of said means for conditioning air.

4. The equipment of claim 1, further comprising;

a unit for storing and handling of containers filled with said articles, said storing and handling unit constituting a part of a respective said magazine and establishing a respective said enclosure, wherein each said enclosure established by said storage and handling unit is arranged to have the air inside such enclosure conditioned by said means for conditioning air.

5. The equipment of claim 4, further comprising:

a substantially airtight casing encompassing said storage and handling unit in its entirety and accommodating at least part of said means for conditioning air.

* * * * *